US008650663B2

(12) United States Patent
Fair et al.

(10) Patent No.: US 8,650,663 B2
(45) Date of Patent: Feb. 18, 2014

(54) BUNTING BAG WITH COVER

(75) Inventors: Paul Fair, Denver, CO (US); Jamie Kummerfeld, Wheat Ridge, CO (US)

(73) Assignee: The Boppy Company, LLC, Golden, CO (US)

( * ) Notice: Subject to any disclaimer, the term of this patent is extended or adjusted under 35 U.S.C. 154(b) by 272 days.

(21) Appl. No.: 13/107,653

(22) Filed: May 13, 2011

(65) Prior Publication Data

US 2012/0284897 A1 Nov. 15, 2012

(51) Int. Cl.
*A41B 13/06* (2006.01)

(52) U.S. Cl.
USPC ..... 2/69.5

(58) Field of Classification Search
USPC ..... 2/69.5, 111, 75, 80, 86, 88, 89, 96; 5/494, 498, 482, 485
See application file for complete search history.

(56) References Cited

U.S. PATENT DOCUMENTS

| | | | | | |
|---|---|---|---|---|---|
| 1,915,044 | A | * | 6/1933 | Anderson | 2/69 |
| 2,020,155 | A | * | 11/1935 | Molter | 2/82 |
| 2,358,410 | A | * | 9/1944 | Mattesius | 2/69.5 |
| 2,530,464 | A | * | 11/1950 | Haman | 2/69.5 |
| 2,624,048 | A | * | 1/1953 | Kovary | 2/69.5 |
| 2,651,781 | A | * | 9/1953 | Buchholz | 2/69.5 |
| 2,704,070 | A | * | 3/1955 | Rudisill | 450/113 |
| 2,932,827 | A | * | 4/1960 | Munro, Jr. | 2/69.5 |
| 4,316,287 | A | * | 2/1982 | Rule | 2/69.5 |
| D269,475 | S | | 6/1983 | Albertson | |
| 4,678,222 | A | | 7/1987 | Kassai | |
| D296,378 | S | | 6/1988 | Coates | |
| 4,761,032 | A | * | 8/1988 | Sanchez et al. | 297/229 |
| 4,823,405 | A | * | 4/1989 | Porter | 2/80 |
| D301,796 | S | | 6/1989 | Sildva | |
| D304,256 | S | | 10/1989 | McEntee | |
| 4,897,885 | A | | 2/1990 | Lunt | |
| 5,046,204 | A | | 9/1991 | Mohler | |
| 5,096,260 | A | | 3/1992 | Hagerstrom | |
| 5,168,579 | A | * | 12/1992 | Marshall | 2/88 |
| 5,243,724 | A | | 9/1993 | Barnes | |
| 5,535,449 | A | * | 7/1996 | Dickey | 2/69 |
| 5,692,257 | A | | 12/1997 | Albertien | |
| 5,781,946 | A | | 7/1998 | McEntire et al. | |
| 5,926,846 | A | * | 7/1999 | Segal | 2/102 |

(Continued)

OTHER PUBLICATIONS

Author Unknown, "4 in 1 Miracle Wrap™ Bunting System," Tivoli Couture, http://www.tivolicouture.com/4-in-1-Miracle-Wrap-Bunting-System.htm, accessed May 10, 2011, 2 pages.

(Continued)

*Primary Examiner* — Alissa L Hoey
(74) *Attorney, Agent, or Firm* — Kilpatrick Townsend & Stockton LLP

(57) ABSTRACT

Embodiments of the invention provide a bunting bag useable with a child seat to cover a child and a method of using a bunting bag. The bunting bag may include a rear blanket having one or more slots that permit one or more straps of a child seat to be positioned through the rear blanket to secure a child within the child seat. The bunting bag may also include a front blanket positioned atop the rear blanket and coupled therewith to form an interior space within which the child may be placed. The front blanket may have a left portion or flap and a right portion or flap that are separable from each other to provide access into the interior space. The bunting bag may further include an insulating blanket removably coupled atop of the front blanket.

15 Claims, 5 Drawing Sheets

(56) References Cited

U.S. PATENT DOCUMENTS

| | | | | |
|---|---|---|---|---|
| 5,950,261 | A * | 9/1999 | Hay et al. | 5/482 |
| 5,988,742 | A | 11/1999 | Stevens | |
| 5,996,146 | A | 12/1999 | McPherson | |
| 6,012,189 | A * | 1/2000 | Dudley | 5/655 |
| 6,055,686 | A | 5/2000 | Knight | |
| 6,145,932 | A * | 11/2000 | Hamel-Nyhus et al. | 297/465 |
| 6,266,822 | B1 * | 7/2001 | Joyce | 2/83 |
| 6,272,683 | B1 * | 8/2001 | Symms et al. | 2/69.5 |
| 6,321,389 | B1 | 11/2001 | Sankey | |
| 6,394,543 | B1 * | 5/2002 | Dunne et al. | 297/219.12 |
| 6,401,248 | B1 * | 6/2002 | Christensen | 2/69 |
| 6,408,439 | B1 * | 6/2002 | Garforth-Crippen | 2/80 |
| 6,415,442 | B1 | 7/2002 | Smith | |
| 6,817,033 | B2 * | 11/2004 | Bailey | 2/69.5 |
| D541,506 | S | 5/2007 | Heiman-Phi | |
| 7,409,726 | B2 * | 8/2008 | Bahm et al. | 2/49.1 |
| 7,409,729 | B2 * | 8/2008 | Bahm et al. | 2/111 |
| 7,431,395 | B2 | 10/2008 | Morgan et al. | |
| 7,530,118 | B2 * | 5/2009 | Osborne et al. | 2/69.5 |
| 7,650,655 | B2 | 1/2010 | Narboni-Campora | |
| 8,032,958 | B2 * | 10/2011 | Pieta et al. | 5/494 |
| 8,151,386 | B2 * | 4/2012 | McKee | 5/500 |
| 8,191,188 | B2 * | 6/2012 | Kaplan et al. | 5/485 |
| 8,214,949 | B2 * | 7/2012 | Thompson | 5/494 |
| 8,225,422 | B1 * | 7/2012 | McSparron | 2/67 |
| 2003/0079270 | A1 * | 5/2003 | Bailey | 2/69.5 |
| 2004/0217633 | A1 * | 11/2004 | Kassai et al. | 297/219.12 |
| 2005/0125895 | A1 * | 6/2005 | Gatten | 5/482 |
| 2005/0150047 | A1 * | 7/2005 | Trani et al. | 5/482 |
| 2005/0155150 | A1 * | 7/2005 | Janish et al. | 5/482 |
| 2005/0246814 | A1 * | 11/2005 | Cooper et al. | 2/111 |
| 2006/0174391 | A1 * | 8/2006 | Shannon | 2/86 |
| 2006/0185055 | A1 * | 8/2006 | DeWitt | 2/111 |
| 2006/0236441 | A1 * | 10/2006 | Johnson et al. | 2/69.5 |
| 2007/0044199 | A1 * | 3/2007 | Ebert | 2/111 |
| 2007/0056098 | A1 * | 3/2007 | Schmid et al. | 5/482 |
| 2007/0192923 | A1 * | 8/2007 | Bahm et al. | 2/49.1 |
| 2008/0196141 | A1 * | 8/2008 | Osborne et al. | 2/111 |
| 2008/0229499 | A1 | 9/2008 | Narboni-Campora | |
| 2008/0313812 | A1 * | 12/2008 | Reeves et al. | 5/655 |
| 2009/0044337 | A1 * | 2/2009 | McKee | 5/496 |
| 2009/0249526 | A1 * | 10/2009 | Carangelo | 2/69.5 |
| 2010/0064412 | A1 * | 3/2010 | Slutzky | 2/84 |
| 2010/0175188 | A1 | 7/2010 | Narboni-Campora | |
| 2010/0257653 | A1 * | 10/2010 | Pitts | 2/69.5 |

OTHER PUBLICATIONS

Author Unknown, "Baby's Cozy World—Cozy Cuddler, Pink, " Walmart.com, http://www.walmart.com/ip/Baby-s-Cozy-World-Cozy-Cuddler-Pink/13031976, accessed May 12, 2011, 1 page.

Author Unknown, "Baby's Cozy World "Cozy Cuddler"Stroller Blanket—Pink,"Amazon.com, http://www.amazon.com/Baby-27s-Cozy-World-Cuddler-Stroller/dp/B001I1QBIU, accessed May 10, 2011, 4 pages.

Author Unknown, Blanket "B212 Evolution®," 7 A.M. Enfant, http://www.7amenfant.com/b212e.html, accessed May 10, 2011, 1 page.

Author Unknown, "Bumbleride 2010 Footmuff and Stroller Liner," Stroller Depot™, http://www.strollerdepot.com/items/bumbleride-footmuff-and-stroller-liner/, accessed May 10, 2011, 2 pages.

Author Unknown, "Cruise Cuddler™," SootheTIME, http://soothtime.com/cruisetime/cruise-cuddler/, accessed May 10, 2011, 3 pages.

Author Unknown "Gallery—Le Sac Igloo LS500,"7 A.M. Enfant, http://www.7amenfant.com/gallery.html, accessed May 12, 2011, 1 page.

Author Unknown, "LA Tivoli Couture stroller and car seat gear and accessories, car seat covers, wearable blankets, stroller liners, bunting bag," Tivoli Couture, http://www.tivolicouture.com/4-in-1-Miracle-Wrap-Bunting-System/LA.htm, accessed May 12, 2011, 2 pages.

Author Unknown, "LA Tivoli Couture stroller and car sear gear and accessories, car seat covers, wearable blankets, stroller liners, bunting bag,"Tivoli Couture, http://www.tivolicouture.com/4-in-1-Miracle-Wrap-Bunting-System/LA.htm, accessed May 12, 2011, 1 page.

Author Unknown, "Original Bundleme,"JJ Cole Collections, http://jjcolecollections.com/original-bundleme, accessed May 10, 2011, 1 page.

Author Unknown, "Original Bundleme containing instructions,"JJ Cole Collections, http://jjcolecollections.com/original-bundleme, accessed May 12, 2011, 1 page.

Author Unknown, "Snuggle Bub Fleece Stroller Bunting—Black," BabyDiaperWorld.com, http://babydiaperworld.com/Snuggle-Bub-Fleece-Bunting-Black.html, accessed May 12, 2011. 5 pages.

* cited by examiner

BUNTING BAG WITH COVER

BACKGROUND OF THE INVENTION

Embodiments of the invention relate generally to coverings for child seats and more specifically to coverings that are useable with stroller seats, infant carriers, and car seats to cover or partially cover a child seated in a stroller seat, infant carrier, or car seat.

Child seats are designed to safely secure a child to protect the child during transportation and/or other activities. Child seats include infant carriers, car seats, strollers, and the like. Infant carriers and car seats are close in design and function, except that infant carriers are generally designed to removably couple with a base unit secured to a vehicle. The infant carriers may be conveniently removed from the base unit and transported while an infant or newborn remains restrained within the infant carrier.

Child seats are often designed to provide comfort for the child secured within the seat. Typically these seats are made of a plastic or metal base (e.g., polypropylene base or tubing) and include fabric liners, padding (e.g., foam padding), constraint belts, buckles, handles, wheels, and the like. Child seats may also include other components, such as pockets, shade coverings, wheel locks, and the like. Additional components and/or attachments are often used with child seats, such as toys that hang from a handle or trays that attach to the child seat that support the child's food or drink.

Child seats may be used for children of various ages and size ranging from infants to school age children. The child seat may be adjustable so that the child seat may continue to be used as the child grows. When using child seats for newborns and infants, special care is often needed due to the fragile nature of the young children. For example, newborns and infants may get cold while riding in a stroller, infant carrier, or car seat because of their immobility and/or inability to generate enough body heat. Newborns and infants typically lack the ability to communicate when they are cold or otherwise feel uncomfortable. In addition, infant carriers and car seats often face rearward or away from the parent so that the parent may not be able to see or determine when the child is cold or otherwise uncomfortable. Further, placing a coat or jacket on the child to keep the child warm may render buckling the child within the child seat more difficult due to the additional bulky material. For these and other reasons, it may be desirable to cover a child seated in a child seat to keep the child warm and/or comfortable while riding in the child seat.

BRIEF SUMMARY OF THE INVENTION

Embodiments of the invention provide for a bunting bag that may be fitted about a child seat to partially or fully cover a child seated in the child seat. The bunting bag may include an outer periphery defined by a top end, a bottom end, a left side, and a right side. The bunting bag may include a rear blanket having one or more slots that permit a strap or straps of a child seat to be positioned through the rear blanket to secure a child within the child seat. The bunting bag may also include a front blanket positioned atop the rear blanket and coupled with the rear blanket along at least a portion of the right side, the left side, and the bottom end. The front and rear blanket may form an interior space that the child may be placed in. The front blanket may have a left portion or flap and a right portion or flap that are separable from each other to provide access into the interior space. The bunting bag may further include an insulating blanket removably coupled atop of the front blanket along at least a portion of the outer periphery.

In one aspect, the bunting bag includes an arcuate chamber positioned near the top end and that extends from near the left side of the bunting bag to near the right side. The arcuate chamber may receive a padding member that is used to support the head of a child placed in the bunting bag. In one aspect, the bunting bag is enclosed at the bottom end to enclose a child's lower limbs within the interior space and includes an opening at the top end to partially or fully expose the child's head. The front blanket may include a fastening mechanism that is adapted to couple the left portion or flap to the right portion or flap. The fastening mechanism may include a zipper that unzips longitudinally along a centerline of the front blanket. The zipper may extend from the bottom end of the bunting bag to a position adjacent or near the upper chest of a child placed in the bunting bag.

In another aspect, the insulating blanket may be coupled to the front blanket via one or more fasteners that include snaps, hook and loop fasteners, a zipper, buttons, clips, and the like. For example, the insulating blanket may be coupled to the front blanket via one or more zippers that extend along at least a portion of the right side, the left side, and the bottom end. The insulating blanket may include a slit extending longitudinally along a centerline of the insulating blanket that corresponds to the centerline of the front blanket. The slit may allow opposites sides of the insulating blanket to unfold to provide access to the zipper. The insulating blanket may also include a flap that extends over a portion or all of the slit to cover the slit. The flap may include one or more fasteners that fasten the flap closed over the portion of the slit.

In yet another aspect, either or both the front blanket and the insulating blanket includes right and left flaps that are foldable over a child's face to cover the child's face. In one aspect, the child seat is an infant carrier, a car seat, or a stroller seat. The padding that is insertable into the arcuate chamber may include an inflatable air bladder, a pillow, a foam pad, a rubber pad, a fabric casing having a fiberfill cushion interior, and the like. The slots of the rear blanket may be formed from a central portion of the rear blanket. The central portion may have a pair of longitudinally extending slits positioned on opposite sides of a centerline and have a plurality of tabs that extend laterally from near the centerline to one of the longitudinally extending slits. The tabs may be releasably coupled with the rear blanket to form the slots. The tabs may permit one or more of the straps of the child seat to be longitudinally adjusted with respect to the bunting bag to account for the size of the child.

Another embodiment of the invention provides a method of covering a child in a child seat with a bunting bag. The method may include providing a child seat and a bunting bag. The bunting bag may include an outer periphery, a rear blanket, a front blanket, and/or an insulating blanket as described herein. The method may further include placing the bunting bag in the child seat and positioning one or more straps of the child seat through one or more slots of the rear blanket. The method may further include placing the child in the bunting bag, operating the straps to secure the child within the child seat, and fastening a left portion of the front blanket to a right portion to cover the child.

The method may additionally include positioning a padding within an arcuate chamber of the bunting bag, or removing the padding from the arcuate chamber, to adjust the bunting bag based on the size of the child. The method may additionally include attaching the insulating blanket to the front blanket via one or more fasteners to provide additional insulation to the bunting bag. Placing the bunting bag in the child seat may include placing the bunting bag in a stroller seat, an infant carrier, or a car seat. Fastening the left portion of the front blanket to the right portion may include operating a zipper extending longitudinally near a centerline of the front blanket.

Another embodiment of the invention provides a bunting bag for a child seat. The bunting bag may include a top end, a bottom end, a right side, and a left side. The bunting bag may also include a rear blanket having one or more slots that permit one or more securing straps of the child seat to be positioned through the rear blanket to secure a child within the child seat. The bunting bag may further include a front blanket positioned atop the rear blanket and coupled with the rear blanket along at least a portion of the right side, the left side, and the bottom end to form an interior space within which the child may be placed. The bunting bag may additionally include an arcuate chamber near the top end that is configured to receive a padding to adjust the bunting bag based on the size of the child.

The bunting bag may additionally include an insulating blanket removably coupled atop the front blanket along at least a portion of the right side, the left side, and the bottom end. In one aspect, the front blanket may include a left portion or flap and a right portion or flap that is separable from the left portion to provide access into the interior space. In another aspect, the front blanket may also include a fastening mechanism extending longitudinally near a centerline of the front blanket. The fastening mechanism may be operable to couple the left portion to the right portion. The fastening mechanism may be a zipper that extends from the bottom end to a position corresponding to the upper chest of a child placed in the bunting bag.

Another embodiment of the invention provides a bunting bag that includes a rear blanket having one or more slots that permit one or more straps of a child seat to be positioned through the rear blanket to secure the child within the child seat. The bunting bag also includes a front blanket positioned atop the rear blanket and coupled therewith along at least one side to form an interior space within which the child is placed. The front blanket includes a right cover and a left cover that open near a centerline to provide access to the interior space. The bunting bag further includes an insulating blanket coupled atop the front blanket along at least one side of the front or rear blanket. The insulating blanket is removable from the front blanket.

BRIEF DESCRIPTION OF THE DRAWINGS

The present disclosure is described in conjunction with the appended figures.

Figure 1:
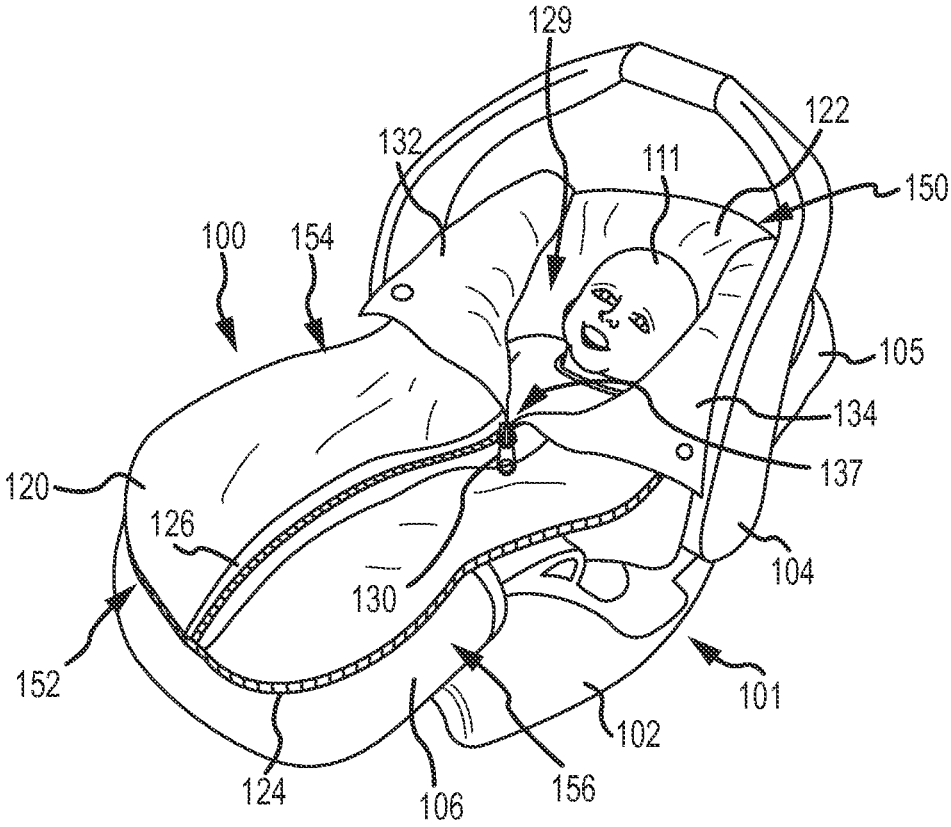
FIG. 1 illustrates a bunting bag being used with an infant carrier to cover a child positioned in the infant carrier according to an embodiment of the present invention.

In the appended figures, similar components and/or features may have the same reference label. Where the reference label is used in the specification, the description is applicable to any one of the similar components having the same reference label.

DETAILED DESCRIPTION OF THE INVENTION

Embodiments of the present invention provide for a bunting bag and methods of using a bunting bag. The bunting bag may be used with an infant carrier, a car seat, a stroller, or any other child seat or carrier to cover or partially cover a child seated in the infant carrier, car seat, stroller seat, or other seat. The bunting bag is particularly useful to cover an infant or newborn placed in the child seat to insulate the infant or newborn and keep them warm and comfortable. Although the figures illustrate and the specification generally describes the bunting bag being used with an infant carrier or stroller seat, it should be realized that the bunting bag may be used with any seat that a child may be placed in. Further, it should be realized that while the specification generally describes an infant carrier, the description equally applies to other car seats that may not be removable from a vehicle and that may be used for toddlers. In addition, the bunting bag may be used for other applications that do not include a child seat or carrier. For example, the bunting bag may be used separately or independent of a child seat or carrier, such as when a child is placed within the bunting bag for comfort and warmth and held by a parent or guardian.

The bunting bag generally includes a front blanket and rear blanket. The front blanket and rear blanket are coupled together to form an interior space within which the child may be placed. The front blanket includes flaps that open to allow access to the interior space so that the child may be placed in the bunting bag or removed therefrom. The bunting bag may also include an insulating blanket that is coupled with the front blanket and that provides additional insulation to the bunting bag to further insulate the child. The insulating blanket may include flaps that open similar to the front blanket to allow access to the interior space and/or to a fastening mechanism of the front blanket (e.g., a zipper). The rear blanket includes slots through which securing straps of an infant carrier or stroller seat may be placed so that the child may be secured in the infant carrier or stroller.

The front blanket, rear blanket, and/or insulating blanket may be made of a breathable fabric material so that air and/or perspiration may flow through the blankets to the child. Further, the front, rear, and/or insulating blanket may include a single layer of fabric, multiple layers of fabric coupled together, a padding disposed or positioned between multiple layers of fabric, an insulating liner coupled with a fabric, and the like. The fabric material of the front, rear, and/or insulating blanket may also be water resistant to protect the child from rain, snow or other moisture. Examples of materials that may be used as the fabric material include nylon, LYCRA, polyester, cotton, cotton-polyester blend, rayon, and the like. The bunting bag may also include various attachment mechanisms or members that allow the blankets, flaps, and the like to be coupled together. These and other features of the bunting bag will be further realized with reference to the figures.

FIG. 1 illustrates a bunting bag 100 fitted about or coupled with an infant carrier 101. The infant carrier 101 includes a base portion 102, which may be made of a plastic and/or metal material. The infant carrier 101 also includes a front portion 106 and a rear portion 105 that form a seat within which the child is placed. The infant carrier 101 also includes straps or belts (not shown) that buckle around the child to secure the child within the infant carrier 101. Typically, infant carriers 101 include a pair of shoulder belts (not shown) that are positioned over the child's shoulders and arms. The shoulder belts are buckled to a lower belt and buckle that are placed between the child's legs. The shoulder belts, lower belt, and buckle form a 5 point harness mechanism that contacts the child's shoulders, hips, and groin to secure the child within the seat. The infant carrier may also include a chest clip (not shown) that couples the shoulder belts together in relation to the child's chest and that is vertically adjustable as the child grows. Likewise, the shoulder belts may be vertically adjusted in relation to the infant carrier 101 to account for the growth of a child. Infant carriers 101 also typically include a pull strap (not shown) that is used to tighten the 5 point harness when secured about the child. Alternatively, the infant carrier may use restraint belts and buckles that form a 3 point harness mechanism. For example, the infant carrier may include a pair of restraint belts that are placed over the child's shoulders that couple with a buckle attached to a restraint belt placed between the child's legs.

The infant carrier 101 also includes a handle 104 that allows a parent, guardian, or other person to transport the infant carrier and child 111. The infant carrier 101 may also include various padding (not shown), fabric (not shown), and other features that are aesthetically pleasing and/or that comfort the child 111.

The bunting bag 100 is fitted about or coupled with the infant carrier 101 to partially or fully cover the child 111 seated in the infant carrier 101. The bunting bag 100 includes an outer periphery 124 defined by a top end 150, a bottom end 152, a left side 154, and a right side 156. The bunting bag 100 includes a rear blanket 122 and a front blanket 120 positioned atop the rear blanket. The bunting bag 100 may or may not also include an insulating blanket (not shown, but see FIG. 3). The front blanket 120 and rear blanket 122 are coupled together to form an interior space 129 within which the child 111 is placed. For example, the front blanket 120 and rear blanket 122 may be sewn along the outer periphery 124 along the left side, the right side and the bottom end to form a hollow interior 129 similar to a sleeping bag.

The rear blanket 122 includes one or more slots (not shown, but see elements 382 and 385 of FIG. 4) that permit straps or belts of the infant carrier 101 to be positioned through the rear blanket 122 to secure the child 111 within the infant carrier 101. The rear blanket 122 may also include an arcuate chamber (not shown, but see FIG. 4) within which a padding (not shown, but see FIG. 4) may be placed to support the child's head and/or cushion and comfort the child 111. The front blanket 120 includes a left portion or flap 132 and a right portion or flap 134 that are separable from each other to provide access into the interior space 129. In one embodiment, the left flap 132 is separable from the right flap 134 along a centerline 126 or center portion of the front blanket 120. When separated from each other, the left flap 132 folds or hangs over the left side of the infant carrier 101 while the right flap 134 folds or hangs over the right side of the infant carrier 101. The interior space 129 is easily accessible because the left and right flaps, 132 and 134, separate along the centerline 126 of the front blanket 120 and the entire mid portion of the interior space 129 is exposed. Placement of the child 111 within the interior space 129 and removal of the child 111 therefrom is greatly facilitated due to the central separating left and right flaps, 132 and 134.

Similarly, the central separating left and right flaps, 132 and 134, also greatly facilitate in securing or buckling the child 111 within the infant carrier 101 since the central portion of the interior space 129 is exposed, which is typically where the infant carrier's belts and buckles are located. The bunting bag 100 may include one or more fastening mechanisms positioned along centerline 126 that releasably couple the left and right flaps, 132 and 134. For example, FIG. 1 illustrates front blanket 120 including a zipper 130 positioned along centerline 126. The zipper 130 may extend along centerline 126 from the bottom end 152 to a position 137 corresponding to or adjacent the upper chest of the child 111 placed within bunting bag 100. The zipper 130 may be zipped or unzipped to provide access to interior space 129. The upper portions of left and right flaps, 132 and 134, may be folded over the child's face or unfolded therefrom to fully or partially cover the child 111 within the interior space 129. The bunting bag 100 may partially or fully enclose the lower limbs and legs of the child 111 at the bottom end of the bunting bag while allowing the child's head, chest, and/or arms, or a portion therefore, to be exposed through an opening at the top end.

Although FIG. 1 illustrates the front blanket 120 including left and right flaps, 132 and 134, that are separable along centerline 126, other embodiments could include a single flap that is separable along an edge of the blanket or include front and left flaps that are separable along a line closer to the left side or right side. For example, the front blanket 120 may include a single flap that is coupled via a zipper to the right side of the bunting bag.

Figure 2:
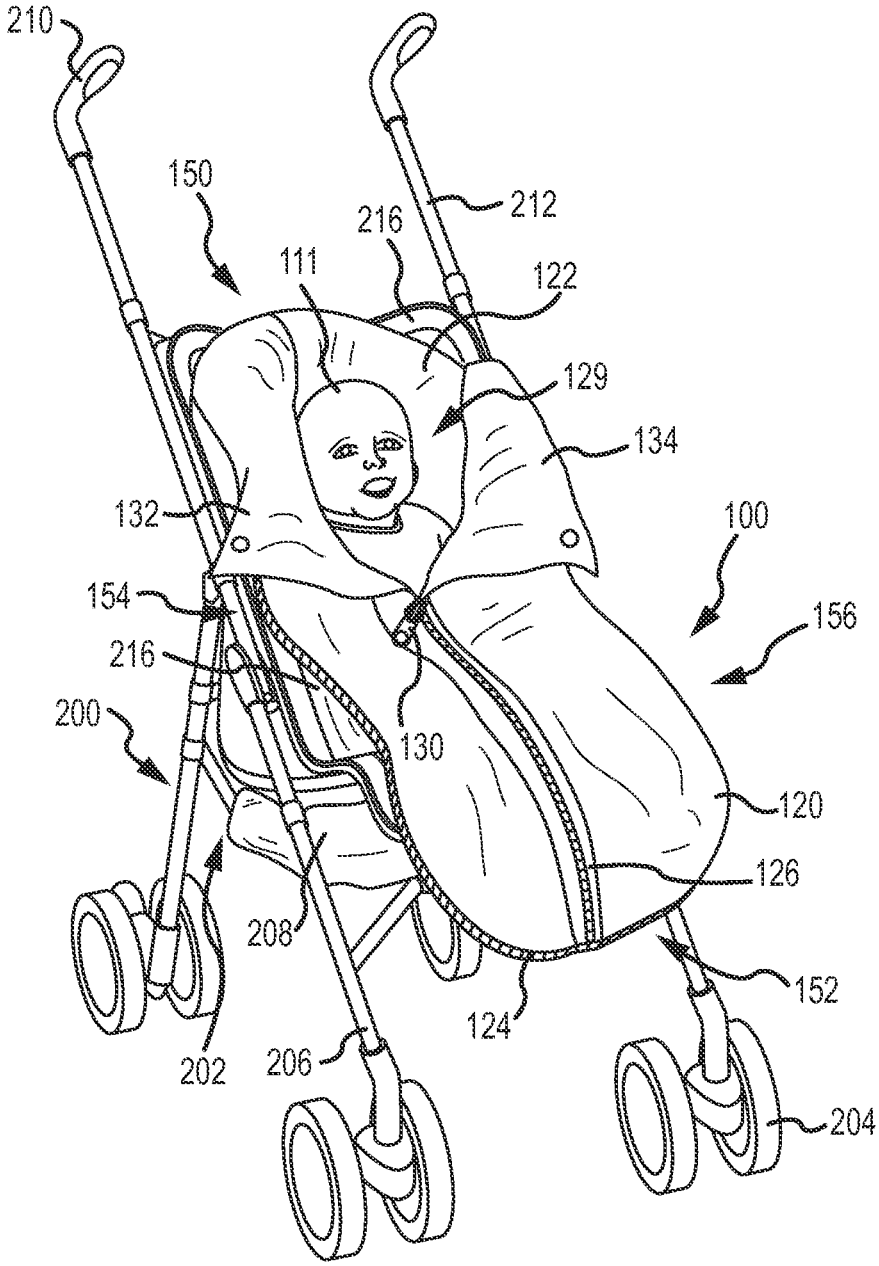
FIG. 2 illustrates the bunting bag of FIG. 1 being used with a stroller seat to cover a child seated in the stroller seat according to an embodiment of the present invention.

FIG. 2 illustrates bunting bag 100 fitted about or coupled with a stroller. The stroller includes a frame 200 and a seat 202 coupled to the frame 200. The frame 200 includes a plurality of legs 206 that each include one or more wheels 204 upon which the stroller rolls. Although FIG. 2 depicts the stroller including four legs that each include two wheels 204, the stroller may include less wheels and/or legs (e.g., three wheeled jogging strollers and the like). The seat 202 includes a bottom portion 208 upon which the child 111 sits and a back support 216 that supports the child's back.

The frame 200 or seat 202 may also include a shade covering (not shown) positioned above the child's head that folds open to partially cover and shade the child 111 or that folds up in an accordion like manner and is positioned adjacent the back support 216 when not being used. The frame 200 may also include a handle or pair of handles 210 that a user grasps to push the stroller. The handles 210 may be attached to the frame 200 via extension tubes 212. In one embodiment, the frame 200 is made of metal or plastic tubing. The frame 200 and/or seat 202 may be foldable to facilitate storage and/or transportation of the stroller. The stroller may also include straps or belts (not shown) that buckle around the child to secure the child within the stroller. The belts or straps of the stroller may be similar to the 5 point harness of the infant carrier 101. Alternatively, the stroller's belts or straps may include a lap belt (not shown) that is placed around the child's waist and that couples to a buckle (not shown) secured to a lower belt (not shown) placed between the child's legs. Such a belt configuration would provide a 3 point harness that does not secure the child's shoulders against the stroller seat. The stroller may also include various padding (not shown), fabric (not shown), and other features that are aesthetically pleasing and/or that comfort the child 111.

The bunting bag 100 is fitted about or coupled with the stroller to partially or fully cover the child 111 seated in the stroller. As described herein, the bunting bag 100 includes an outer periphery 124 defined by top end 150, bottom end 152, left side 154, and right side 156. The bunting bag 100 also includes a rear blanket 122 and a front blanket 120 positioned atop the rear blanket and may also include an insulating blanket (see FIG. 3) removably coupled with the front blanket 120. The front blanket 120 and rear blanket 122 are coupled together to form an interior space 129 within which the child 111 is placed.

The rear blanket 122 includes one or more slots (see elements 382 and 385 of FIG. 4) through which the straps or belts of the stroller are positioned to secure the child 111 within the seat 202 of the stroller. The rear blanket 122 may also include an arcuate chamber (see FIG. 4) within which a padding (see FIG. 4) may be placed to support the child's head and/or cushion and comfort the child 111. The front blanket includes a left flap 132 and a right flap 134 that are separable from each other to provide access into the interior space 129. As described herein, the left and right flaps, 132 and 134, may be separated along a centerline 126 of the front blanket 120 or at some other location via fasteners 130, such as a zipper, zippers, button, clips, snaps, hook and loop fasteners, and the like. The right and left flaps, 132 and 134, may provide easy access to the interior space 129 and/or to the belts or straps of the stroller.

The upper portions of left and right flaps, 132 and 134, may be folded over the child's face or unfolded therefrom to fully or partially cover the child 111 within the interior space 129. Similarly, the bunting bag 100 may partially or fully enclose the lower limbs and legs of the child 111 at the bottom end while allowing the child's head, chest, and/or arms, or a portion therefore, to be exposed through an opening at the top end.

Figure 3:
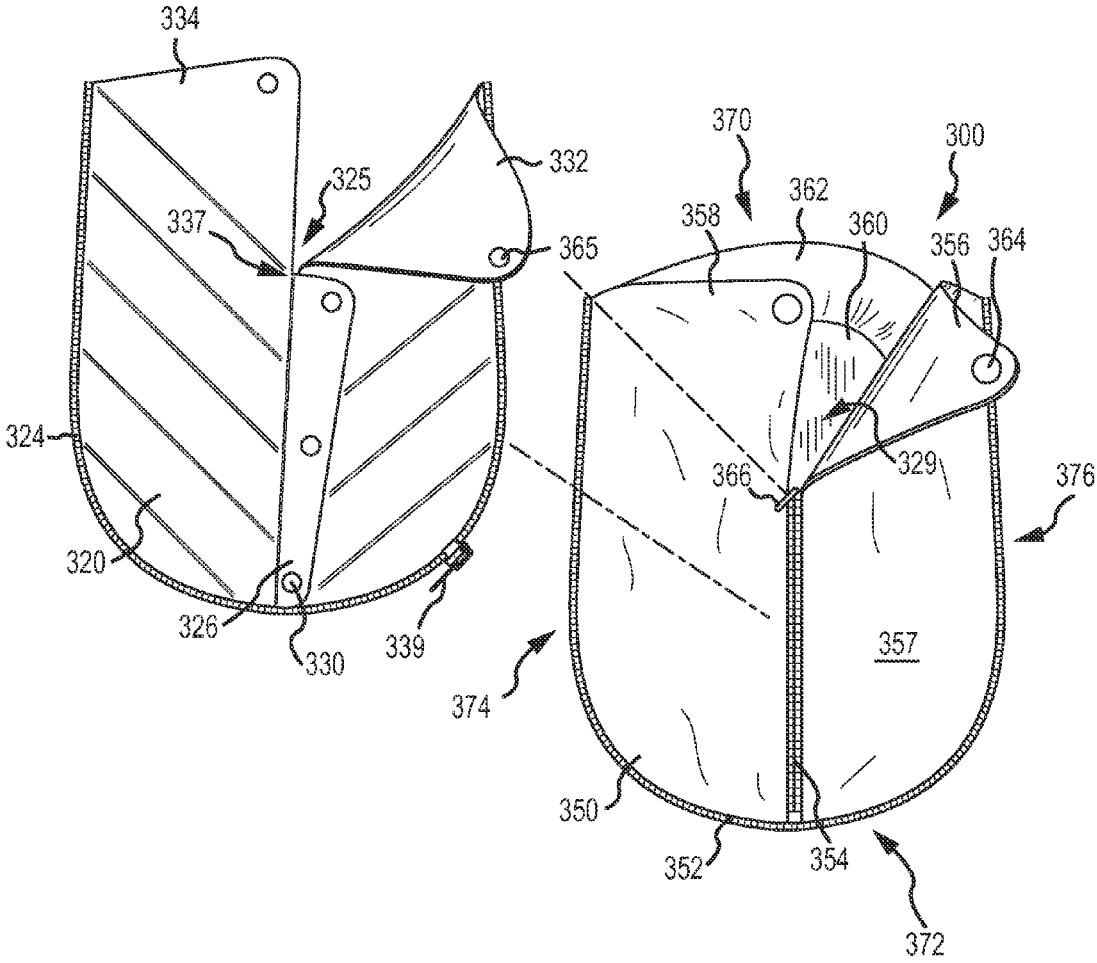
FIG. 3 illustrates an exploded view of the bunting bag of FIG. 1 illustrating placement of an insulating blanket to the bunting bag.

FIG. 3 illustrates a bunting bag 300 having a removable insulating blanket 320. The bunting bag 300 includes a front blanket 350 positioned atop a rear blanket 360. The front and rear blankets, 350 and 360, may be similar to those described herein. The bunting bag includes an outer periphery or edge 352 defined by a top end 370, a bottom end 372, a left side 374, and a right side 376. The front blanket 350 includes a left flap 358 and a right flap 356. The left flap 358 is separable from the right flap 356 along a centerline 354 of the front blanket 350. A zipper mechanism 366 is coupled with the left and right flaps, 358 and 356, to couple or decouple the left and right flaps, 358 and 356, and thereby provide access to the interior space 329. Zipper mechanism 366 extends along centerline 354 from bottom end 372 to position 357. Position 357 is adjacent or near the upper chest of a child when the child is placed within bunting bag 300. The rear blanket 360 also includes an arcuate chamber 362 having one or more padding positioned therein to support and/or cushion a child's head.

The insulating blanket 320 is positionable atop the front blanket 350 or removable therefrom. The insulating blanket 320 provides additional insulation for a child positioned within the interior space 329 of bunting bag 300. For example, the insulating blanket 320 may be coupled with the bunting bag 300 when the infant carrier or stroller is being used in cold, windy, or cool areas. The insulating blanket 320 may be especially useful for newborns and infants that are not mature enough to produce sufficient body heat to keep warm without additional insulation. The insulating blanket 320 includes an outer edge or periphery 324 that corresponds to the outer edge or periphery 352 of the front and rear blankets, 350 and 360. The insulating blanket 320 is couplable with the bunting bag 300, via one or more fasteners 339, by attaching the outer edge or periphery 324 of the insulating blanket 320 with the outer edge or periphery 352 of the bunting bag 300 or front blanket 350. The fasteners may include snaps, hook and loop fasteners, zipper, buttons, clips, magnets, and the like. For example, in one embodiment, the insulating blanket 320 is coupled to the front blanket 350 via a zipper 339 that extends along the right side, the left side, and the bottom end of the outer periphery 352 of bunting bag 300 and outer periphery 324 of insulating blanket 320.

The left and right flaps, 334 and 332, of the insulating blanket 320 are separable along a centerline 325 to provide access to the zipper mechanism 366 so that the zipper mechanism 366 may be operated to access the interior space 329. The insulating blanket 320 may include a slit (not shown) that extends along the centerline 325 and that corresponds to the centerline 354 of the front blanket 350. The slit may allow the left and right flaps, 334 and 332, to unfold to provide access to the zipper mechanism 366. A flap 326 may fold over the centerline 325 of the insulating blanket 320 to cover the slit. Flap 326 may extend from bottom end 372 to a position 337 that corresponds with position 357 of front blanket 350. Flap 326 may provide additional insulation by preventing air from flowing through the slit. Although not shown, the front blanket 350 may also include a flap similar to flap 326 to cover the centerline 354 and/or zipper mechanism 366. The right and left flaps, 334 and 332, may be coupled or secured together via one or more fasteners 330, such as buttons, snaps, zipper (s), hook and loop fasteners, magnets, and the like. The flap 326 may include the fasteners 330, such as buttons or snaps, that fasten the flap closed over the portion of the slit. In one embodiment, the left and right flaps, 334 and 332, may be coupled together via a zipper (not shown) that extends along the slit and the flap may be secured over the slit and/or zipper via fastener 330. The zipper may extend from bottom end 372 to position 337 that corresponds with position 357 (i.e., a position adjacent or near the upper chest of a child placed within bunting bag 300.

In one embodiment, the left and right flaps, 358 and 356, of front blanket 350 and/or the left and right flaps, 334 and 332, of insulating blanket 320 are foldable over the face of a child positioned in the interior space 329 to cover the child's face or un-foldable from the child's face so that the head, arms, and/or chest are exposed to the outside environment. The left and right flaps, 358 and 356, of front blanket 350 also include fasteners 364 that correspond to fasteners 365 of left and right flaps, 334 and 332, of insulating blanket 320. The fasteners, 364 and 365, may be coupled together (e.g., buttoned, snapped, and the like) so that the left and right flaps of the front blanket and insulating blanket act as single flaps. For example, when coupled together, the left and right flaps of the front blanket and insulating blanket may be opened or closed simultaneously or folded over a child's face or removed therefrom simultaneously.

Figure 4:
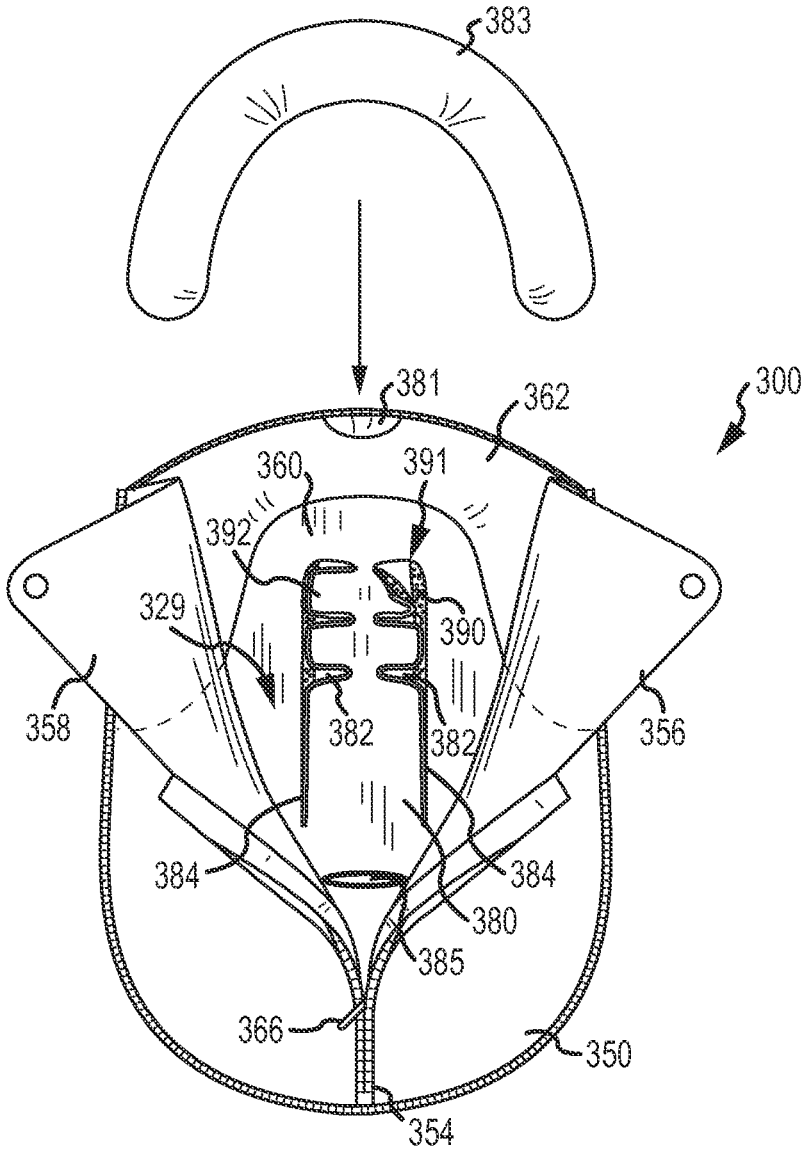
FIG. 4 illustrates the bunting bag of FIG. 1 showing a padding that may be positioned within an arcuate chamber of the bunting bag according to an embodiment of the present invention.

With reference to FIG. 4, illustrated is the bunting bag 300 of FIG. 3 shown in greater detail. The bunting bag 300 includes a front blanket 350, a rear blanket 360, a fastening mechanism 366, a centerline 354, a left flap 358, and a right flap 356 as described herein. The bunting bag 300 illustrated in FIG. 4 is not shown as being coupled with an insulating blanket, although the bunting bag may include an insulating blanket. FIG. 4 also illustrates the fastening mechanism 366 being operated (e.g., unzipped) and the left and right flaps, 358 and 356, being folded back to provide access to the interior space 329. FIG. 4 further illustrates an arcuate chamber 362 positioned near or adjacent the top end of the bunting bag 300. The arcuate chamber 362 extends from the left side of the bunting bag 300 to the right side adjacent the outer edge or periphery of the top end of bunting bag 300. The arcuate chamber 362 includes an opening 381 through which a padding member 383 may be inserted into the arcuate chamber 362. The opening 381 may be located near the uppermost point of the top end of bunting bag 300. The opening 381 may include a zipper (not shown) so that the opening 381 may be zipped closed to secure the padding member 383 within the arcuate chamber 362. In another embodiment, the opening 381 may include another fastener (e.g., buttons, snaps, hook and loop fastener, and the like) or may include a flap (not shown) that may fold over the padding member 383 and tuck into opening 381. In addition, opening 381 may be located on the rear surface of rear blanket 360, located near the right or left side of the bunting bag, or located elsewhere.

The fabric forming arcuate chamber 362 may be a fabric different than the fabric of rear blanket 360. For example, the fabric of arcuate chamber 362 may be a stretch fabric or an elastic/resilient fabric (e.g., jersey knit, stretch jersey knit, Lycra® fabric, and the like). Such fabric may expand to hold padding member 383 tightly within arcuate chamber 362 without smashing the padding member and may contract when padding member 383 is not used so arcuate chamber 362 appears to be a smooth flat surface. The fabric may provide a visually appealing appearance regardless of whether a padding member is used.

The padding member 383 is positioned in the arcuate chamber 362 to adjust the size of the bunting bag 300 in order to accommodate small children, such as infants and newborns. The padding member 383 may be used to support the head of an infant or newborn, which may lack sufficient neck strength to support their own head. Additionally or alternatively, the padding member 383 may be used to cushion and comfort a child's head, such as when the child is resting or sleeping. The padding member 383 may include an inflatable air bladder, a pillow, a foam pad, a rubber pad, a gel material, a fabric casing having a fiberfill cushion/interior, and the like. The inflatable air bladder may be inflated between a plurality of sizes to adjust the size and/or cushioning capability of the padding. Likewise, the other padding materials may be swapped and/or adjusted to vary the size and cushioning capability of the padding. The exterior surface of padding member 383, such as the fabric casing, may be made of a substantially smooth, slick, low friction material to facilitate insertion of the padding member 383 within and extraction of the padding member from arcuate chamber 362. The low friction material may prevent the padding member 383 from catching the interior surface of the arcuate chamber 362 and kinking during insertion or reduce such occurrences. The low friction materials that may be used include polyester, nylon, and the like. In addition, the padding member 383 may include separate pieces that may be inserted into the arcuate chamber 362 or into one of several compartments of the arcuate chamber 362.

FIG. 4 additionally illustrates several slots, 382 and 385, of rear blanket 360. The slots include a lower centrally located slot 385 through which a buckle (not shown) and central strap (not shown) of a child seat may be placed. The buckle and central strap may be positioned between a child's leg and used in a 5 point harness, a 3 point harness, or any other securing harness to secure the child within the child seat. The slots also include a plurality of horizontally oriented and vertically spaced slots 382 that are disposed on both sides of a centerline of rear blanket 360 that corresponds to the centerline 354 of front blanket 350. The slots 382 are formed from a plurality of tabs 392 of a central portion 380 of the rear blanket 360. The central portion 380 includes a pair of longitudinally or vertically extending slits 384 disposed on opposite sides of the centerline of rear blanket 360.

The plurality of tabs 392 extend laterally from near the centerline of rear blanket 360 to one of the longitudinally extending slits 384. The slots 382 are formed in the region adjacent or between the tabs 392. The surface of rear blanket 360 adjacent the longitudinally extending slits 384 may include a fastener 390, such as a hook and loop fastener, that releasably couples with the tabs 392 and/or central portion 380. The tabs 392 may be releasably coupled with the rear blanket 360 via the fastener 390 to form the slots 382. The tabs 392 permit the belts or straps of the child seat to be vertically or longitudinally adjusted with respect to the bunting bag 300 to account for the size of the child. For example, to vertically adjust a belt of the child seat, an adjacent tab 392 (either vertically above or below the belt) may be decoupled from the fastener 390 of rear blanket 360 and folded toward the centerline of the rear blanket as shown by arrow 391. The folded tab 392 (arrow 391) allows the belt to be vertically adjusted from one slot 382 to an adjacent slot. The tab 392 may then be unfolded and re-secured or re-coupled to the fastener 390 of rear blanket 360. In this manner, the belts or straps of the child seat may be easily adjusted with respect to the bunting bag to accommodate the growth of a child or to accommodate different sized children. Additional straps, such as side straps of a 5 point harness, may be placed through the central portion 380 and/or the bunting bag 300 may include other slots to accommodate other belts or straps.

Figure 5:
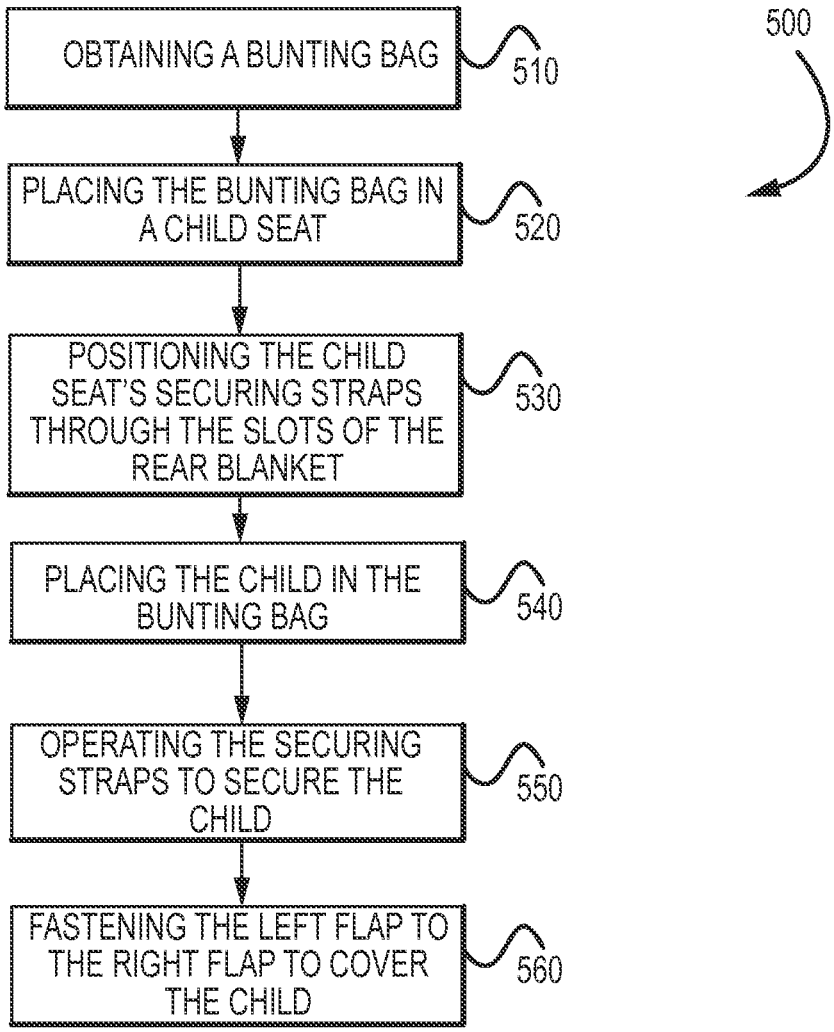
FIG. 5 illustrates a method of covering a child with a bunting bag according to an embodiment of the present invention.

FIG. 5 illustrates a method 500 of covering a child positioned in a child seat with a bunting bag. At block 510, a bunting bag is obtained or provided. The bunting bag may include an outer periphery, a rear blanket, a front blanket, an insulating blanket, an arcuate chamber, and/or other features described herein. At block 520, the bunting bag is placed in the child seat (e.g., infant carrier, stroller seat, and the like). At block 530, the securing straps or belts of the child seat are positioned through slots of the rear blanket. At block 540, the child is placed in the bunting bag. At block 550, the securing straps or belts are operated to secure the child within the child seat. At block 560, a left flap of the front blanket is fastened to a right flap of the front blanket to cover the child. Fastening the left flap to the right flap may include operating a zipper extending longitudinally near a centerline of the front blanket.

The method may additionally or alternatively include other steps not depicted in FIG. 5. For example, the method may also include positioning a padding within an arcuate chamber of the bunting bag or removing the padding from the arcuate chamber to adjust the bunting bag based on the size of the child. Similarly, the method may additionally include attaching an insulating blanket to the front blanket via one or more fasteners to provide additional insulation for the child. The use of the bunting bag may also include several non-child seat or child carrier uses. For example, the bunting bag may be used separately or independent of a child seat or carrier, such as when a child is placed within the bunting bag for comfort and warmth and held by a parent or guardian. In such uses, the bunting bag need not include the slots or openings in the rear blanket that allow straps or belts to be positioned through the rear blanket.

Having described several embodiments, it will be recognized by those of skill in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

As used herein and in the appended claims, the singular forms "a", "an", and "the" include plural referents unless the context clearly dictates otherwise. Thus, for example, reference to "a process" includes a plurality of such processes and reference to "the device" includes reference to one or more devices and equivalents thereof known to those skilled in the art, and so forth.

Also, the words "comprise," "comprising," "include," "including," and "includes" when used in this specification and in the following claims are intended to specify the presence of stated features, integers, components, or steps, but they do not preclude the presence or addition of one or more other features, integers, components, steps, acts, or groups.

What is claimed is:

1. A bunting bag comprising:

a bag body having an outer periphery defined by a top end, a bottom end, a left side, and a right side, the bag body further comprising:

a rear blanket having an outer periphery; and a front blanket having an outer periphery, wherein the front blanket is positioned atop the rear blanket and coupled therewith along at least a portion of the right side, the left side, and the bottom end to form an interior space within which a child is placed, the front blanket having a left portion and a right portion that are separate from each other such that the right portion and the left portion may be distanced from each other to provide access into the interior space, wherein the front blanket includes a front blanket fastening mechanism that couples the left portion to the right portion; and an insulating blanket having an outer periphery, wherein the insulating blanket is removably coupled atop the front blanket such that the outer periphery of the insulating blanket is aligned with the outer periphery of the front blanket, wherein an outer periphery fastening mechanism attaches the outer periphery of the insulating blanket to the outer periphery of the front blanket, wherein the insulating blanket comprises a slit extending longitudinally along a centerline of the insulating blanket that provides access to the left portion and the right portion of the front blanket and the front blanket fastening mechanism, the slit allowing opposites sides of the insulating blanket to unfold to provide access to the front blanket fastening mechanism, and wherein the insulating blanket further comprises an insulating blanket fastening mechanism that opens and closes the slit.

2. The bunting bag of claim 1, further comprising an arcuate chamber positioned near the top end of the bag body, the arcuate chamber configured to receive a padding member, wherein the chamber extends from near the left side to near the right side to permit the padding member to support the head of a child placed in the bunting bag.

3. The bunting bag of claim 1, wherein the bunting bag is enclosed at the bottom end to enclose the child's lower limbs within the interior space, and wherein the bunting bag includes an opening at the top end to expose at least a portion of the child's head.

4. The bunting bag of claim 1, wherein the outer periphery fastening mechanism comprises one or more zippers that extend along at least a portion of the right side, the left side, and the bottom end.

5. The bunting bag of claim 1, wherein the front blanket fastening mechanism comprises a zipper that unzips longitudinally along the centerline of the front blanket.

6. The bunting bag of claim 1, wherein one side of the insulating blanket comprises a flap that extends over at least a portion of the slit, the flap including a plurality of fasteners that fasten the flap closed over the portion of the slit.

7. The bunting bag of claim 2, wherein the padding member comprises one or more types of padding selected from the group consisting of: an inflatable air bladder, a pillow, a foam pad, a fabric casing having a fiberfill cushion, and a rubber pad.

8. The bunting bag of claim 1, wherein the rear blanket includes one or more slots that permit one or more straps of a child seat to be positioned through the rear blanket to secure a child within the child seat.

9. The bunting bag of claim 8, wherein the child seat comprises an infant carrier, a car seat, or a stroller seat.

10. The bunting bag of claim 8, wherein the one or more slots comprise a central portion of the rear blanket, the central portion having a pair of longitudinally extending slits disposed on opposite sides of a centerline and having a plurality of tabs that extend laterally from near the centerline to a corresponding longitudinally extending slit, the tabs being releasably coupled with the rear blanket to form the slots.

11. The bunting bag of claim 10, wherein the tabs permit the one or more straps of the child seat to be longitudinally adjusted with respect to the bunting bag based on the size of the child.

12. A bunting bag comprising:

a rear blanket having an outer periphery, the rear blanket including one or more slots that permit one or more straps of a child seat to be positioned through the rear blanket to secure a child within the child seat;

a front blanket having an outer periphery, wherein the front blanket is positioned atop the rear blanket and coupled therewith along at least one side to form an interior space within which the child is placed, the front blanket including a right cover and a left cover that are separate from each other such that the right cover and the left cover may be distanced from each other to provide access to the interior space, wherein the front blanket includes a front blanket fastening mechanism that couples the left cover to the right cover; and an insulating blanket having an outer periphery, wherein the insulating blanket is coupled atop of the front blanket such that the outer periphery of the insulating blanket is aligned with the outer periphery of the front blanket or the outer periphery of the rear blanket, wherein an outer periphery fastening mechanism attaches the outer periphery of the insulating blanket to at least one of the outer periphery of the front blanket and the outer periphery of the rear blanket, the insulating blanket being removable from the front blanket, wherein the insulating blanket comprises a slit extending longitudinally along a centerline of the insulating blanket that provides access to the left cover and the right cover of the front blanket and the front blanket fastening mechanism, the slit allowing opposites sides of the insulating blanket to unfold to provide access to the front blanket fastening mechanism, and wherein the insulating blanket further comprises an insulating blanket fastening mechanism that opens and closes the slit.

13. A bunting bag comprising:

a bag body having an outer periphery defined by a top end, a bottom end, a left side, and a right side, the bag body further comprising:

a rear blanket having an outer periphery; and a front blanket having an outer periphery, wherein the front blanket is positioned atop the rear blanket and coupled therewith along at least a portion of the right side, the left side, and the bottom end to form an interior space within which a child is placed, the front blanket having a left portion and a right portion that are separate from each other such that the right portion and the left portion may be distanced from each other to provide access into the interior space, wherein the front blanket includes a zipper that couples the left portion to the right portion; and an insulating blanket having an outer periphery, wherein the insulating blanket is removably coupled atop the front blanket such that the outer periphery of the insulating blanket is aligned with the outer periphery of the front blanket, wherein an outer periphery fastening mechanism attaches the outer periphery of the insulating blanket to the outer periphery of the front blanket, wherein the insulating blanket comprises a slit extending longitudinally along a center portion of the insulating blanket that provides access to the left portion and the right portion of the front blanket and the sipper, the slit allowing opposites sides of the insulating blanket to unfold to provide access to the zipper, and wherein the insulating blanket further comprises an insulating blanket fastening mechanism that opens and closes the slit.

14. The bunting bag of claim 13, wherein one side of the insulating blanket comprises a flap that extends over at least a portion of the slit, the flap including a plurality of snaps that fasten the flap closed over the portion of the slit.

15. The bunting bag of claim 13, wherein the zipper extends part way from a bottom portion towards a top portion of the front blanket, and further comprising a separate fastener positioned at the top portion of the front blanket that is spaced apart from the zipper.

* * * * *